United States Patent [19]

Schels et al.

[11] Patent Number: 5,055,639

[45] Date of Patent: Oct. 8, 1991

[54] CONTACT ARRANGEMENT FOR A VACUUM SWITCH

[75] Inventors: Wilhelm Schels, Laaber; Manfred Niegl; Rainer Behrend, both of Regensburg, all of Fed. Rep. of Germany

[73] Assignee: Sachsenwerk Aktiengesellschaft, Regensburg, Fed. Rep. of Germany

[21] Appl. No.: 511,730

[22] Filed: Apr. 20, 1990

[30] Foreign Application Priority Data

May 10, 1989 [DE] Fed. Rep. of Germany ..... 3915287

[51] Int. Cl.[5] ..... H01H 33/66

[52] U.S. Cl. ..... 200/144 B

[58] Field of Search ..... 200/144 R-151

[56] References Cited

U.S. PATENT DOCUMENTS 3,946,179 3/1976 Murano et al. ..... 200/144 B
4,667,070 5/1987 Zuckler ..... 200/144 B

FOREIGN PATENT DOCUMENTS 1640039 8/1971 Fed. Rep. of Germany .
2443141 5/1978 Fed. Rep. of Germany .
3406535 5/1987 Fed. Rep. of Germany .
1478702A 7/1977 United Kingdom .

*Primary Examiner*—J. R. Scott
*Attorney, Agent, or Firm*—Spencer & Frank

[57] ABSTRACT

A contact arrangement for a vacuum switch having a switch axis along which switch contacts move. Two identically configured switch contacts are relatively movable opposite to one another along the switch axis. Each switch contact includes: a contact pin for connecting the switch contact with a switch terminal; a contact plate; and a coil body for generating an axial magnetic field. The coil body has at least one winding section extending circumferentially parallel to the contact plate and has a first end connected with the contact plate and a second end connected by an approximately radial conductor section with the contact pin. The side of the winding section facing the contact plate lies continuously against the contact plate and is connected with the contact plate in a conductive manner over the entire length of the winding section. Mutually adjacent winding sections of the two switch contacts lie on top of one another with respect to the switch axis so that the first and second ends of one of the contacts lie above the second and first ends, respectively, of the other of the contacts.

25 Claims, 7 Drawing Sheets

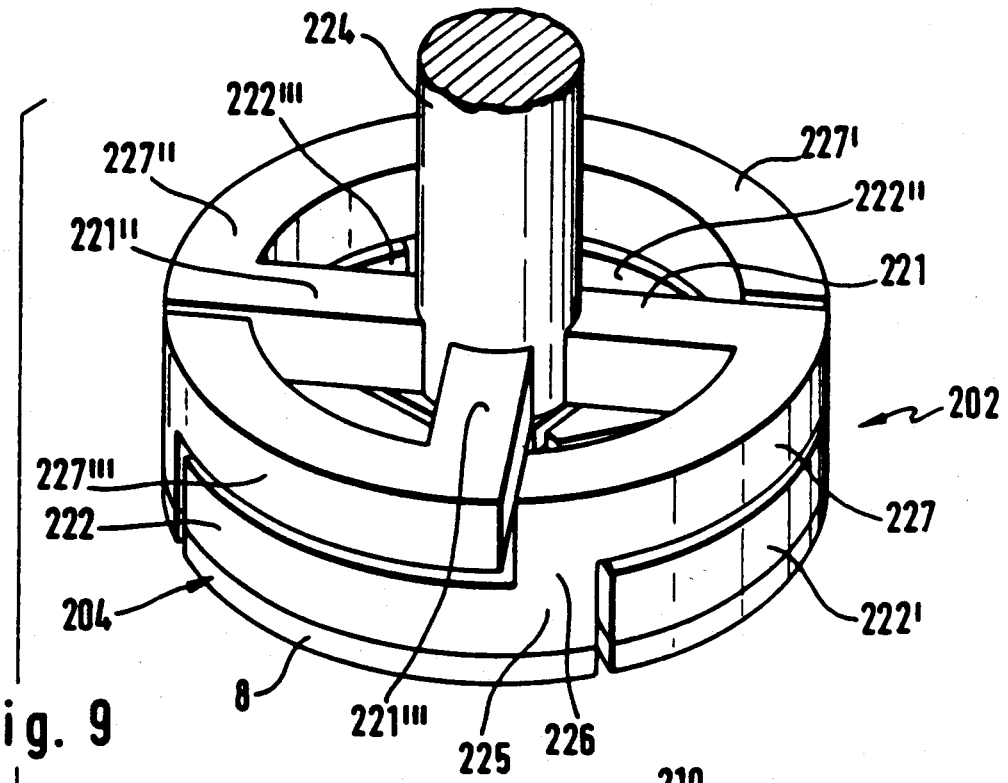
Fig. 9
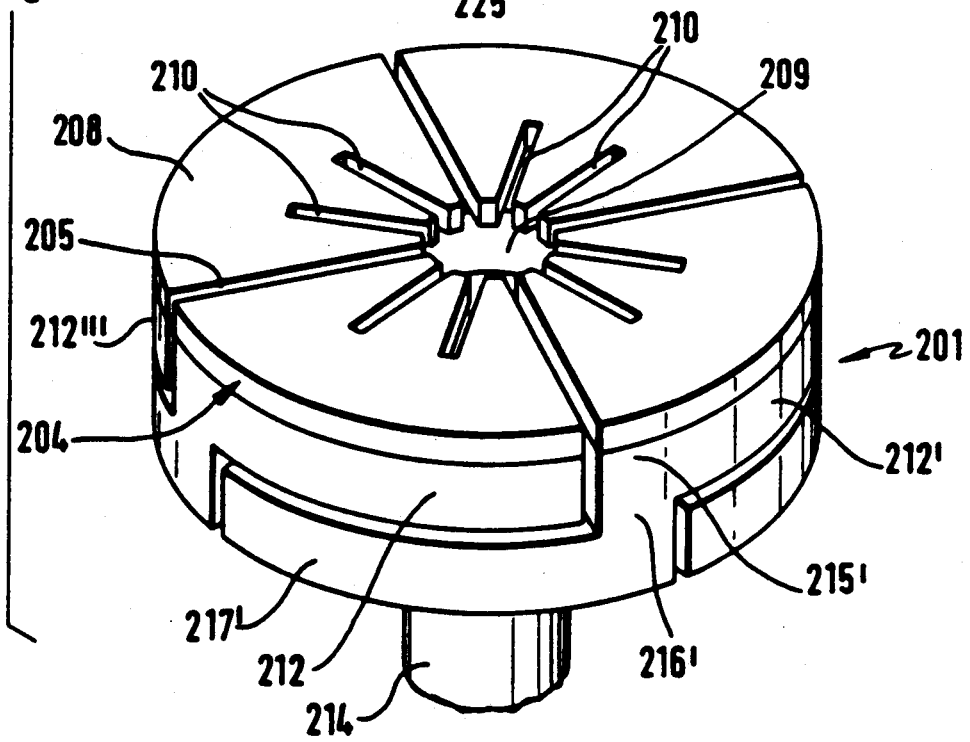

CONTACT ARRANGEMENT FOR A VACUUM SWITCH

CROSS REFERENCE TO RELATED APPLICATION

This application claims the priority of application Ser. No. P 39 15 287.1, filed May 10th, 1989, in the Federal Republic of Germany, the subject matter of which is incorporated herein by reference.

BACKGROUND OF THE INVENTION

The present invention relates to a contact arrangement for a vacuum switch including a pair of identically configured switch contacts which are movable opposite to one another along a switch axis, and more particularly to such a contact arrangement in which each contact is composed of a contact plate and a coil body so as to generate an axial magnetic field, with the winding sections of the coil body extending circumferentially parallel to the contact plate and each winding section being connected at a first end with the contact plate and at a second end, by means of an approximately radial conductor section, with a contact pin which connects the switch contact with a switch terminal.

Such a contact arrangement is disclosed in German Patent No. 2,443,141 and corresponding U.S. Pat. No. 3,946,179. According to those patents, the axial magnetic field in each switch contact, which favorably influences switching behavior, is generated by a coil body installed between the contact pin and the contact plate. The coil body is composed of several, for example four, radial conductor sections which have their inner ends connected with the contact pin and their outer ends with arcuate winding sections which extend in the circumferential direction and are separated from one another by narrow gaps. The winding sections are followed by axially extending short conductor sections to which the common contact plate is fastened, for example by soldering, so as to conduct current.

In order to limit eddy currents, the contact plates of both switch contacts are subdivided by radially oriented slots which begin at the circumference. On the side facing away from the gap, each slot is disposed next to an axial conductor section. In the prior art contact arrangement, the radial conductor sections of the two switch contacts are arranged on top of one another when seen parallel to the axis of the switch, while the winding sections of both contacts are oriented in such a way that current passes through them in the same circumferential direction.

In the switched-on state of the prior art vacuum switch, the contact plates of both switch contacts touch one another at many locations (contact points) under the influence of a strong contact spring. The current threads emanating from these contact points initially travel within the contact plate to one of the four connection locations with the respective axial conductor sections and from there in a bundle through the respective axial conductor section and the subsequent winding section as well as the radial conductor section to the contact pin. FIGS. 6 and 7 of German Patent No. 2,443,141 indicate that, particularly if the contact plates are slotted, long current threads are produced within the contact plates even for contact points near the edge. Due to their high specific electrical resistance, these long current threads generate considerable heat in the contact plate. The current carrying capability of the contacts is further influenced by the fact that the sum of all current threads must pass through the entire length of the four winding sections of each coil body and through the associated soldering locations which act as bottlenecks for the current.

During the time an electric arc burns, the current threads in the contact plates and in the winding sections of the coil bodies flow in the same manner as in the contacted state of the contacts. For part of the current threads, the direction of the current is opposite to that of the closest winding section and cancels out its effect in the induction of the axial magnetic field. This results in a weakening of the magnetic field particularly in the region near the edge of the contact.

SUMMARY OF THE INVENTION

It is an object of the present invention to improve the current carrying capability of vacuum switches of the type first described above and to improve the homogeneity of the axial magnetic field.

The above and other objects are accomplished in accordance with the invention by the provision of a contact arrangement for a vacuum switch having a switch axis along which switch contacts move, including: two identically configured switch contacts which are relatively movable opposite to one another along the switch axis, each switch contact including: a contact pin for connecting the switch contact with a switch terminal; a contact plate; and a coil body for generating an axial magnetic field, the coil body having at least on winding section extending circumferentially parallel to the contact plate and having a first end connected with the contact plate, an approximately radial conductor section and a second end connected by the approximately radial conductor section with the contact pin, with the side of the at least one winding section facing the contact plate lying continuously against the contact plate and being connected with the contact plate in a conductive manner over the entire length of the winding section; and wherein mutually adjacent winding sections of the two switch contacts lie on top of one another with respect to the switch axis so that the first and second ends of one of the contacts lie above the second and first ends, respectively, of the other of the contacts.

The contact arrangement according to the invention provides for making the current threads in the contact plates as short as possible between the contact plates and the individual points of contact and arc base points which are distributed over the entire surface of the contact plates. For this purpose, the winding sections are conductively connected with the contact plate over their entire length. This contact configuration permits minimum current thread lengths within the contact plate. According to a further feature of the invention, an intermediate ring of good conducting material may also be disposed between the winding section and the contact plate so that the current threads are able to penetrate the contact plate only perpendicularly to the contact surface. In this way, heat loss within the switch contacts is minimized.

The inventive positioning of adjacent winding sections in the two switch contacts permits the formation of a sufficient number of ampere windings as required to generate the necessary axial magnetic field. According to another feature of the invention, the winding sections which are conductively connected with the contact plate or with an intermediate ring may be followed by a second layer of further winding sections if this should be necessary to generate the required axial magnetic field and to create sufficient homogeneity of the magnetic field. Moreover, the current threads which are now able to flow only in the radial direction in the contact plate and in the intermediate ring no longer influence the magnitude and distribution of the magnetic field in the contact gap.

Other advantageous features of the invention will become apparent from the following detailed description and the appended claims.

BRIEF DESCRIPTION OF THE INVENTION

For a better understanding of the invention, reference is made to the following drawing figures:

FIG. 9 is a perspective view of a contact arrangement including two-layer coil bodies according to yet a further embodiment of the invention.

DETAILED DESCRIPTION OF THE PREFERRED EMBODIMENTS

Figure 1:
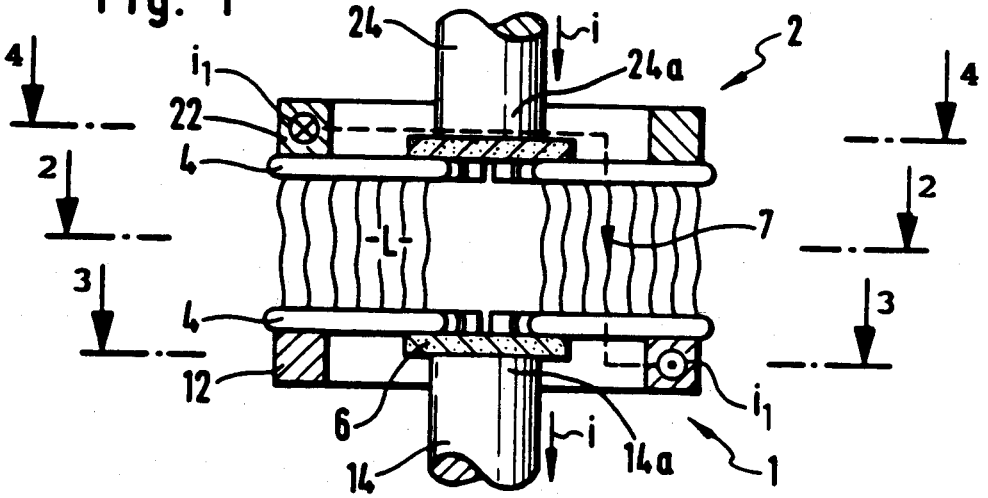
FIG. 1 is a sectional view along line 1—1 of FIG. 2 through the two open switch contacts and illustrating one winding section per contact according to one embodiment of the invention.

Referring to FIGS. 1 to 4, there is shown identically configured switch contacts 1 and 2 in an open position shortly before a current is interrupted. A current i flows, bridging contacts 1 and 2 by way of a diffuse arc L. Switch contact 1 includes a contact plate 4, a coil body in the form of at least one winding section 12, a radial conductor section 11, and a contact pin 14 connected to winding section 12 by radial conductor 11. Similarly, switch contact 2 includes contact plate 4, a coil body in the form of at least one winding section 22, a radial conductor section 21, and a contact pin 24 connected to winding section 22 by radial conductor section 21. The winding sections cover the essential portion of the cylindrical circumference of switch contacts 1 and 2. According to the invention, winding sections 12 and 22 are connected over their entire lengths in a current conductive manner with contact plate 4 while the ends 14*a* and 24*a* of contact pins 14 and 24, respectively, and the radial conductor sections 11 and 21 are each spaced from the respective contact plates 4 for insulation, possibly by way of an insulating and supporting body 6. Each one of winding sections 12 and 22 is terminated at a first end 13 and 23, respectively, by a gap 3 which may be configured as an air gap or may be filled with insulating material or a poorly conducting material. The second ends 15 and 25 of winding sections 12 and 22, respectively, change to radial conductor sections 11 and 21, respectively. The two winding sections 12 and 22, according to a further feature of the invention, face one another over their entire length in such a manner that the first end 13 of winding section 12 is congruent with the second end 25 of winding section 22 and the second end 15 is congruent with first end 23. Thus, gaps 3 of both contacts 1 and 2 are also congruent. In order to avoid eddy currents, contact plates 4 of both switch contacts 1 and 2 are provided with slots 5 which emanate from the circumference. One of these slots coincides with gap 3 so that bridging of the gap by the contact plate is prevented.

During the time that arc L is burning, current path $i_1$ of a partial arc 7 travels on the respectively shortest path to the edge of contact plate 4 (FIG. 2), from there into the adjacent location of winding section 12 of contact 1 (FIG. 1) and analogously from the other arc base point into winding section 22 of contact 2. This path produces a full winding for current path $i_1$ as a percentage of the MMF interlinked to the axial field of the coil bodies. Because the two radially extending sections of current path $i_1$ in contact plates 4 are traversed by the current in opposite directions, they have no influence on the axial magnetic field. The same consideration applies for any desired partial arc in the contact gap between switch contacts 1 and 2. Since the current paths $i_1$ of each individual partial arc extend within contact plate 4 in the radial direction, i.e. on the shortest path to the respective arcuate conductor sections 12 and 22, respectively, the least amount of heat loss is generated in switch contacts 1 and 2 of the vacuum switch according to the invention with the contact geometry otherwise remaining unchanged. The radial current path sections also do not influence the magnetic field in the contact gap.

The present invention gains particular significance in contact arrangements in which contact plates 4 are manufactured of a material having little tendency to weld and great resistance to burning. A sintered or saturated material based on Cu-Cr is particularly suitable for this purpose which, depending on the Cr percentage, has a clearly higher specific resistance than pure Cu. The length of the current threads extending in such contact plates is included to a particularly great degree in the calculation of the heating of the contacts.

Figure 5:
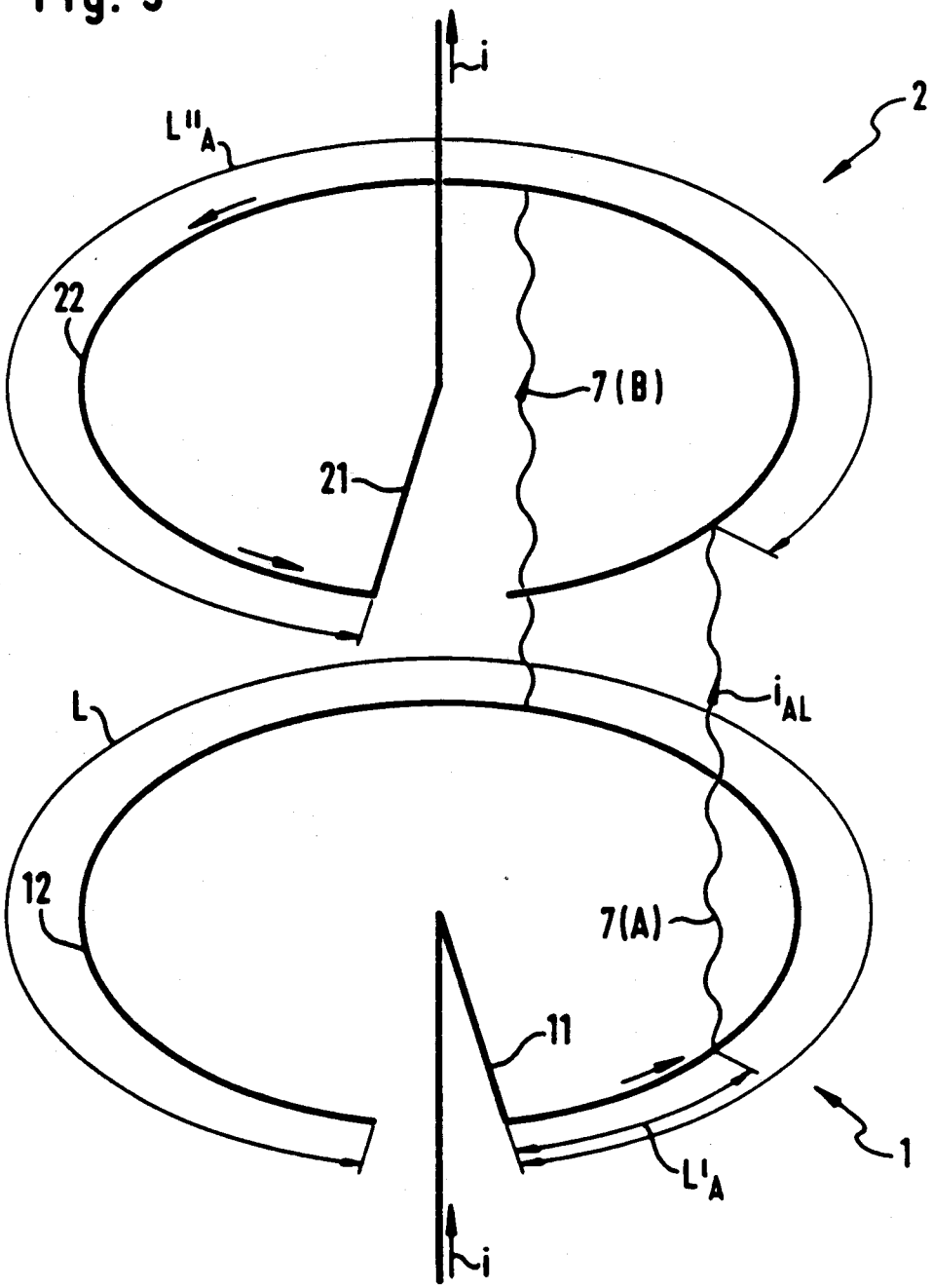
FIG. 5 is a schematic representation with respect to FIG. 1 of the arrangement of the current path with one winding section per switch contact.
Figure 6:
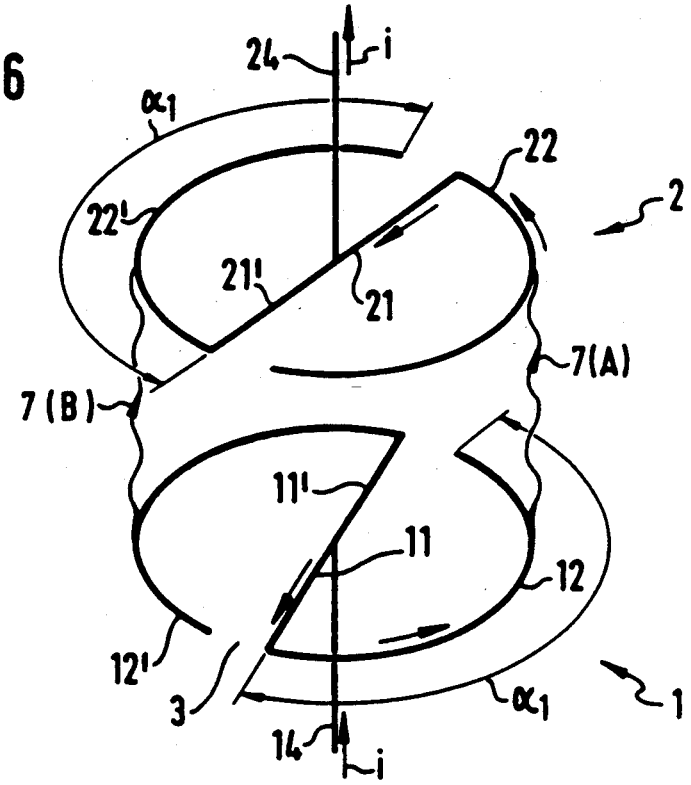
FIG. 6 is a schematic representation of the arrangement of the current path with two winding sections per switch contact according to another embodiment of the invention.
Figure 7:
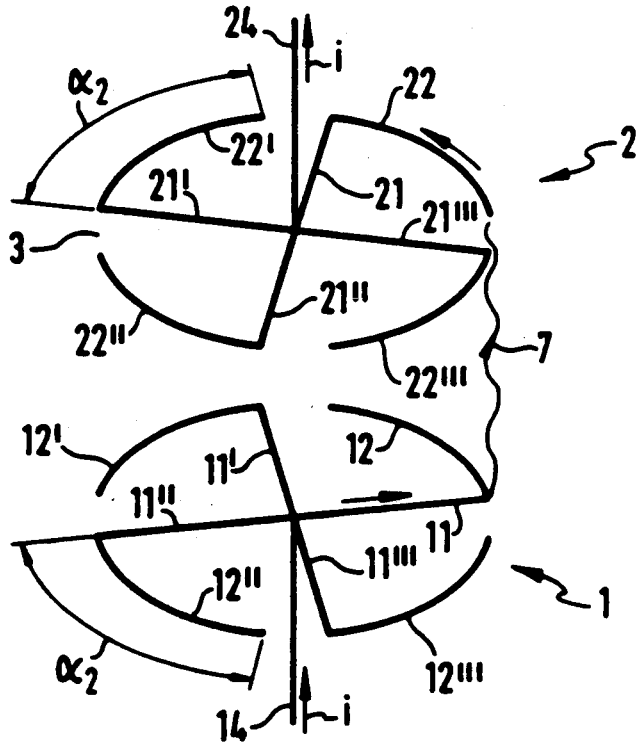
FIG. 7 is a schematic representation of the arrangement of the current path with four winding sections per switch contact according to another embodiment of the invention.

FIGS. 5 to 7 are schematic representations of contact arrangements having one, two or four winding sections per switch contact according to various embodiments of the invention. The structural configuration of the arrangement having one winding section has already been described in detail with reference to FIGS. 1 to 4.

FIG. 5 additionally shows two partial arcs 7(A) and 7(B) and it can be seen that the sum of the length $L'_A$ and $L''_A$ of the current threads for arc 7(A) would be identical to the sum of the length of the corresponding current thread for arc 7(B) in winding sections 12 and 22 and corresponds to the total length L of a winding section. For an arc disposed not at the edge of the contact plates, but within the contact plates (as shown in FIG. 1), the radial components of the current paths extending from the base points to the edge of the contact plate are added to the given current paths.

In FIG. 6, switch contacts 1 and 2 each have two winding sections 12, 12' and 22, 22' respectively, whose radial conductor sections 11, 11' and 21, 21', respectively, at each of the switch contacts emanate from contact pins 14 and 24 in opposite directions. Since, according to the invention, adjacent winding sections 12 and 22, and 12' and 22', face one another so as to produce the above-described effect, the radial conductor sections 11, 11' and 21, 21' in the switch contacts according to the invention are not congruent with one another. In the switch contacts according to FIG. 6, each winding section 12, 12', 22 and 22' form a central angle $\alpha_1$ which is supplemented to 180° by gap 3. FIG. 6 additionally shows partial arcs 7(A) and 7(B) for each winding section of a switch contact. For partial arc 7(A), the current flows through contact pin 14 via radial conductor section 11 to winding section 12 and to the lower base point of arc 7(A). From the upper base point of this arc, the current then travels over the remainder of the angle of winding section 22 and via radial conductor section 21 to contact pin 24. The current path for arc 7(B) is analogous.

FIG. 7 shows two switch contacts 1 and 2, each having four winding sections 12, 12', 12'', 12''' and 22, 22', 22'', 22''', respectively. Each one of these winding sections encloses a central angle $\alpha_2$ which is again supplemented to a right angle of 90° by a gap 3. The current of partial arc 7 travels in an analogous manner as indicated in the two preceding figures.

Figure 8:
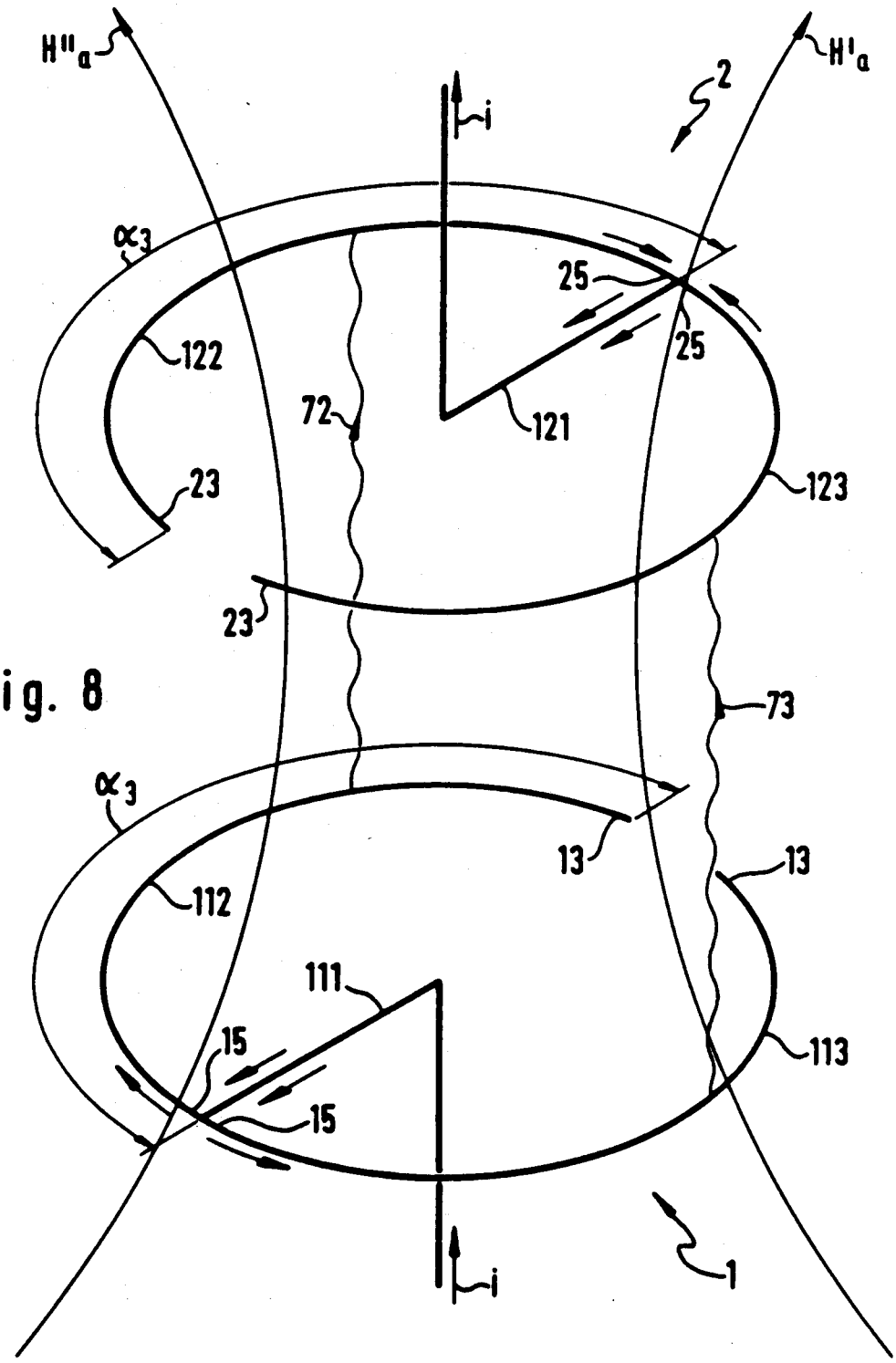
FIG. 8 is a schematic representation of the arrangement of the current path in switch contacts which produce a bipolar magnetic field according to another embodiment of the invention.

The inventive concept can also be applied to contact arrangements having bipolar magnetic fields. FIG. 8 shows an arrangement including two winding sections 112, 113 and 122, 123 for each one of switch contacts 1 and 2, respectively. They are attached in pairs jointly to radial conductor sections 111 and 121, respectively, and extend in opposite directions along the circumference of the contact. The space between first ends 13 and 23 may comprise an air gap or a gap filled with insulating material, such as ceramics, or other electrically poorly conducting material. Since, according to this aspect of the invention, the first ends 13 of switch contact 1 are disposed opposite the second ends 25 of switch contact 2 and first ends 23 of switch contact 2 are disposed opposite second ends 15 of switch contact 1, the radial conductor sections 111 and 121 extend in opposite directions with reference to the switch axis. Here, too, the current threads of partial arc 72 extend in part of winding sections 112 and 122 which, in the illustrated case, enclose supplementary angles. That is, the arc length $\alpha_3$ of each winding section is here supplemented by half the length of air gap 3 to form an angle of 180°. For partial arc 73 as well, arrows indicate the current path in the two winding sections 113 and 123. FIG. 8 additionally shows the direction of the axial magnetic field $H'_a$ - $H''_a$ generated in the contact halves.

The inventive concept can also be used advantageously for switch contacts employing two or multi-layer coil bodies. For example, in FIG. 9 the two switch contacts 201 and 202 are each composed of a contact plate 204, each of which is continuously connected, in the present case, with four winding sections 212, 212', 212''(not visible), 212''' and 222, 222' 222'', 222''', respectively. Referring to winding sections 212' and 222 for ease of description, second ends 215' and 225 of the latter open, each via a short axial conductor section 216' and 226, respectively, into a second layer of winding sections 217' and 227, respectively. These are each traversed by the current in the same winding sense as winding sections 212' and 222. They are connected via radial conductor sections 211' (not visible) and 221, respectively, with contact pin 214 and 224, respectively, of the associated switch contact 201 and 202, respectively. The remaining three winding sections of each contact switch are similarly configured. The spaces between the layers of the winding sections are preferably filled with insulating members or poorly conducting metal bodies. Switch contacts having multi-layer coil bodies can be employed to generate axial magnetic fields of greater magnetic field line densities.

FIG. 9 also shows the subdivision of contact plate 204 into completely separate sectors 208 which each correspond to the sector angle of one of the connected winding sections 212–212''', 222–222'''. Each contact plate 204 may here be provided with a circular recess 209 in its center from which slots 210 emanating from the center create a further subdivision within sectors 208.

Figure 10:
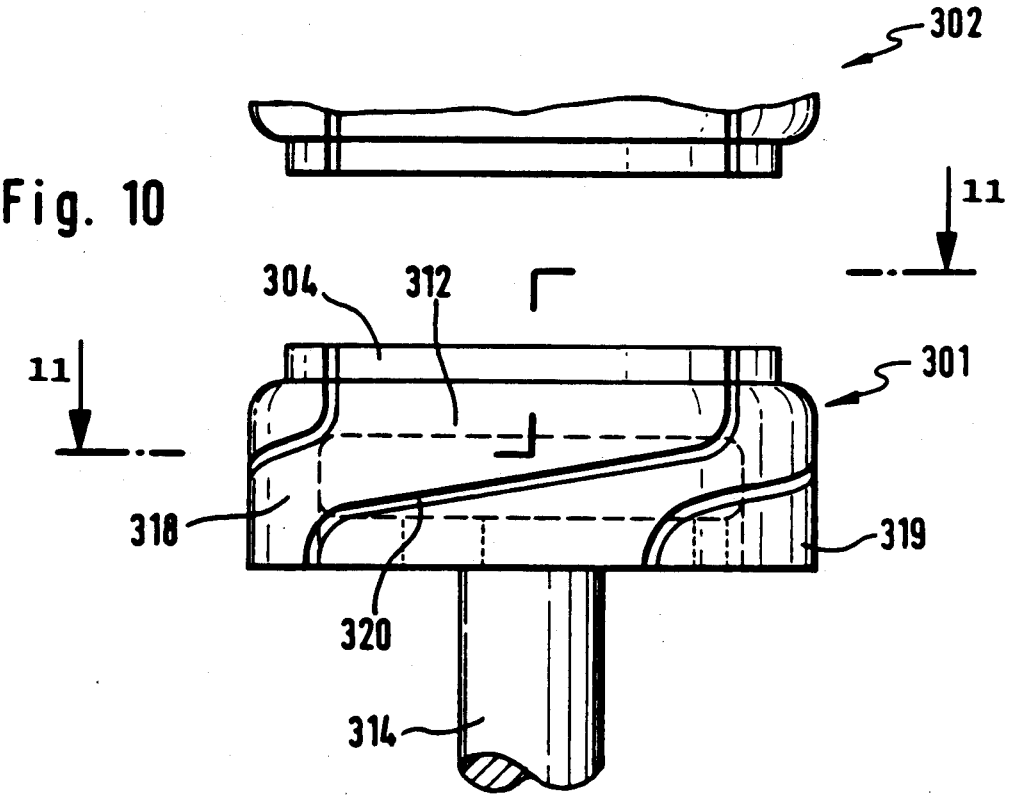
FIG. 10 is a front view of a contact arrangement having obliquely slotted switch contacts according to a another embodiment of the invention.
Figure 11:
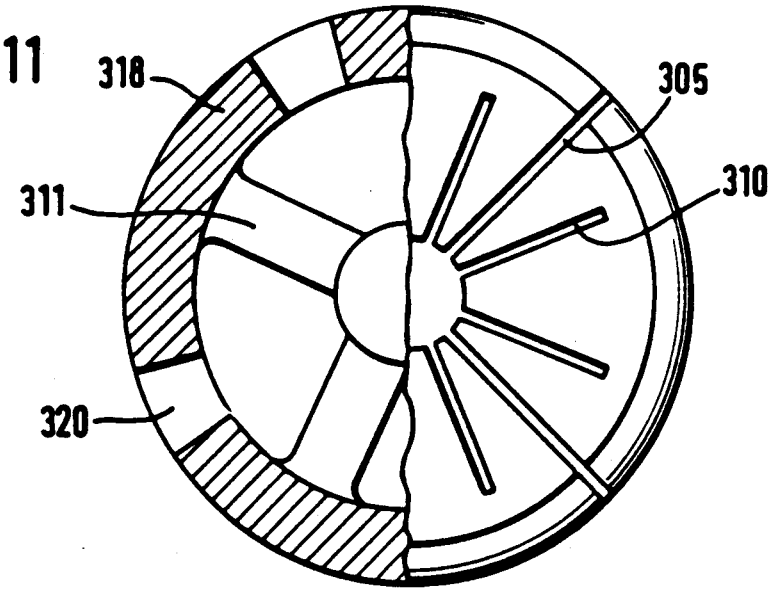
FIG. 11 is a partial sectional view along line 11—11 FIG. 10.

The inventive concept of the invention can further be applied to advantage with cup-shaped switch contacts having obliquely slotted tubular sleeves. FIGS. 10 and 11 show such a contact arrangement in which only switch contact 301 is shown as a whole while switch contact 302 is shown only in part. Contact plate 304 of switch contact 301 is connected continuously in the manner already described with a number of winding sections 312. Along tubular sleeve 319, helical conductor sections 318 are provided which are subdivided by oblique slots 320. Each helical conductor section 318 continuously tapers it's height and opens into the total length of a winding section 312. Each section 318 is continued at its lower end in a radial conductor section 311 which establishes a connection with contact pin 314. The operation of the just described contact arrangement corresponds in all essential respects precisely to the arrangement described in the preceding embodiments.

Figure 2:
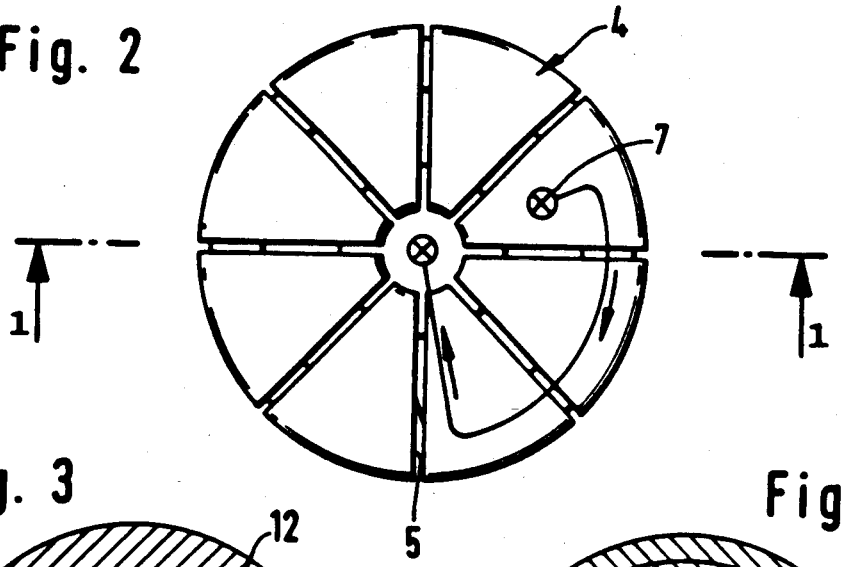
FIG. 2 is a top view along line 2—2 of FIG. 1 onto the lower switch contact.
Figure 3:
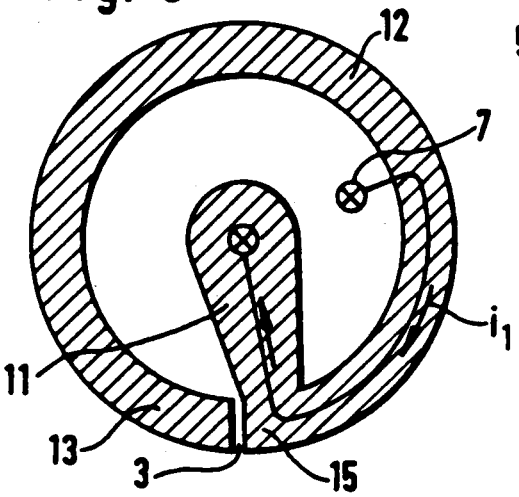
FIG. 3 is a sectional view along line 3—3 of FIG. 1 the lower switch contact.
Figure 4:
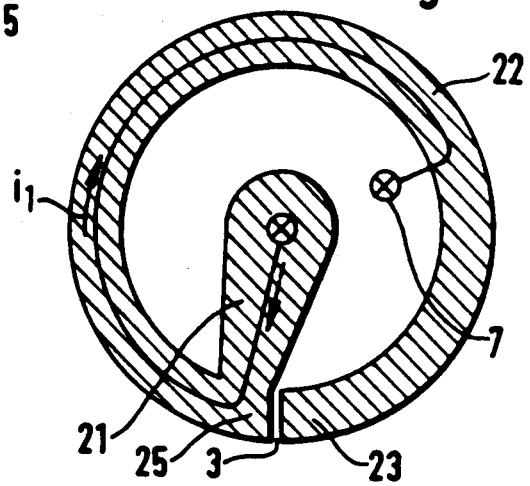
FIG. 4 is a sectional view along line 4—4 of FIG. 1 through the upper switch contact.

In accordance with the basic inventive concept, it is recommended to configure the slots as shown in FIG. 2, 9 or 11 or to employ a different arrangement of slots. In the contact arrangement according to the present invention, these slots do not serve to improve the axial magnetic field, but rather to prevent stray currents within the contact plate. Instead of the slots, notches or grooves may also be employed in a known manner on the side of the contact plate facing away from the contact surface.

In order to improve the mechanical stiffness of the switch contacts according to the invention, supporting bodies 6 may be provided in a known manner, as shown for example in FIG. 1, to support the thin-walled contact plate 4 against the frontal face of contact pins 14 and 24 or against the corresponding side of the radial conductor sections 11 and 21. Supporting bodies 6 may be produced of an insulating material, e.g. ceramics or a poorly conducting, non-ferromagnetic material.

Figure 12:
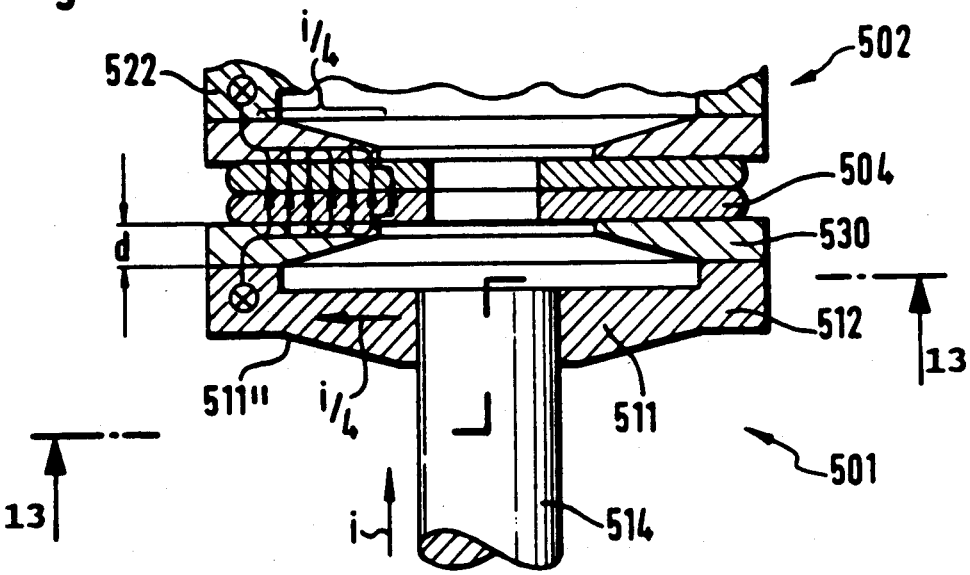
FIG. 12 is a cross-sectional view along line 12—12 of FIG. 13 through a contact arrangement including an intermediate ring in each switch contact according to further embodiment of the invention.
Figure 13:
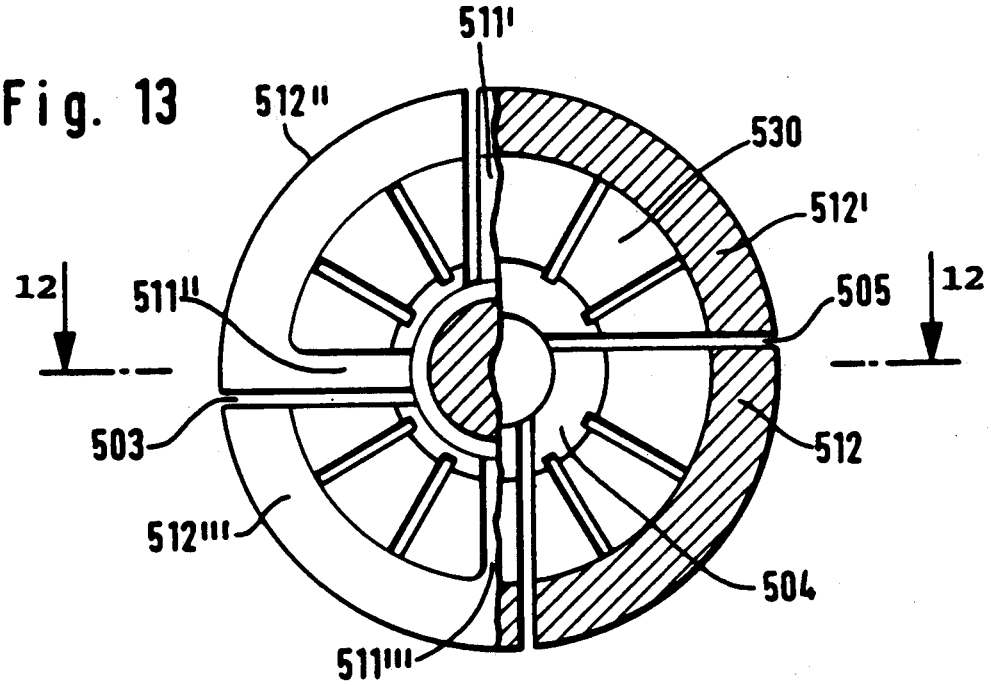
FIG. 13 is a partial sectional view along line 13—13 of FIG. 12 through a switch contact.

A further reduction of heat loss in the switch contacts may be accomplished, as shown in FIGS. 12 and 13, by the incorporation of an intermediate ring 530 of a good conducting material, e.g. electrolyte copper, between contact plate 504 and winding sections 512 and 522. This intermediate ring 530 extends at least underneath part of contact plate 504. FIGS. 12 and 13, show a sectional view of the configuration of a switch contact 501 which is provided with such an intermediate ring 530, with the contact in this case being provided with four winding sections 512, 512', 512'', 512'''. Thus, a current i/4 flows through the radial conductor sections 511, 511', 511'', 511''' of the respective winding sections. Since, in power switches, the specific resistance of the contact plate generally is a multiple of the specific resistance of the coil body and the contact plate has a thickness of only a few millimeters, preferably 2 mm to 3 mm, intermediate ring 530 regulates the current supply so that contact plate 504 is penetrated only in the form of current threads oriented perpendicularly to the contact surface and in the region within the winding sections. In this way, heat loss within switch contacts 501 and 502 is minimized. According to the invention, intermediate ring 530 should have a thickness d for this purpose which is at least as great as that of contact plate 504. The intermediate rings should also be subdivided, similarly to contact plate 504, by slots, grooves, notches or the like.

According to a further aspect of the invention, the coil body may be made from a member molded from a casting or pressing substance, wherein the spaces between the ends of the winding section are formed by shaped-in insulating members or poorly conducting metal bodies.

According to another aspect of the invention, the contact plate of each switch contact comprises a material having a low tendency to weld and a high resistance to burning from switching arcs. Such contact plate consists of a sintered or saturated material based on Cu-Cr as described in German Patent No. 3,406,535 or German Patent No. 1,640,039.

Obviously, numerous and additional modifications and variations of the present invention are possible in light of the above teachings. It is therefore to be understood that within the scope of the appended claims, the invention may be practiced otherwise than as specifically claimed.

What is claimed is:

1. A contact arrangement for a vacuum switch having a switch axis along which switch contacts move, comprising:

two identically configured switch contacts which are relatively movable opposite to one another along the switch axis, each switch contact including:

a contact pin for connecting the switch contact with a switch terminal;

a contact plate having a central circular recess, said contact plate being divided into at least two separate sectors by at least two radially oriented slots emanating from said recess, with each said sector being subdivided by additional slots emanating from said recess; and a coil body for generating an axial magnetic field, said coil body having at least two winding sections extending in a circumferential direction of said switch contact, each of said at least two winding sections having a first end connected with said contact plate, at least one approximately radial conductor section and a second end connected by said at least one approximately radial conductor section with said contact pin, each of said at least two winding sections having a side facing and lying against a respective one of said at least two separate sectors of said contact plate, and being connected with that sector in a conductive manner over the entire length of said side; and wherein mutually adjacent winding sections of said two switch contacts lie on top of one another with respect to the switch axis so that said at least two separate sectors of the contact plate of one of said switch contacts are arranged congruently to said at least two separate sectors of the contact plate of the other of said switch contacts.

2. A contact arrangement as defined in claim 1, wherein said at least two winding sections describe almost a complete circle and whose ends are separated from one another by air gaps.

3. A contact arrangement as defined in claim 1, wherein said at least two winding sections describe almost a complete circle and whose ends are separated from one another by gaps filled with insulating material.

4. A contact arrangement as defined in claim 3, wherein said insulation material comprises ceramics.

5. A contact arrangement as defined in claim 1, wherein said at least two winding sections, with reference to the switch axis, exhibit the same central angles and whose ends are separated from one another by air gaps.

6. A contact arrangement as defined in claim 1, wherein said at least two winding sections, with reference to the switch axis, exhibit the same central angles and whose ends are separated from one another by gaps filled with insulating material.

7. A contact arrangement as defined in claim 6, wherein said insulating material comprises ceramics.

8. A contact arrangement as defined in claim 1, wherein the coil body of each said switch contact includes an even number of winding sections arranged in pairs with the second end of the winding sections of each pair of winding sections being connected to a radial conductor section which extends in the opposite direction from the corresponding radial conductor section of the other switch contact, said winding sections of each said pair of winding sections forming, with reference to the switch axis, the same central angles, with the first ends of said winding sections of each pair of winding sections being separated from one another by an air gap.

9. A contact arrangement as defined in claim 1, wherein the coil body of each said switch contact includes an even number of winding sections arranged in pairs with the second end of the winding sections of each pair of winding sections being connected to a radial conductor section which extends in the opposite direction from the corresponding radial conductor section of the other switch contact, said winding sections of each said pair of winding sections forming, with reference to the switch axis, the same central angles, with the first ends of said winding sections of each pair of winding sections being separated from one another by a gap filled with insulating material.

10. A contact arrangement as defined in claim 9, wherein said insulating material comprises ceramics.

11. A contact arrangement as defined in claim 1, wherein said at least two winding sections comprise first and second winding layers offset from one another in the axial direction and an axial oriented conductor section, the first said winding layer having one end connected with said contact plate and being conductively connected with said contact plate along its entire side facing said contact plate, the other end of said first winding layer being connected to one end of said second winding layer by said axially oriented conductor, the other end of said second winding layer being connected to a respective one of said radial conductor sections.

12. A contact arrangement as defined in claim 11, wherein said winding layers of each winding section are separated from the winding layers of adjacent winding sections by gaps which are filled by a poorly conducting metal material.

13. A contact arrangement as defined in claim 1, and further including at least one helically configured conductor connected between a respective one of said at least two winding sections and a respective one of said radial conductor sections.

14. A contact arrangement as defined in claim 13, wherein each of said at least one helical conductor continuously tapers it's height and opens into the entire arc length of the respective winding section.

15. A contact arrangement according to claim 1, wherein said contact plate comprises a material having a low tendency to weld and a high resistance to burning from switching arcs.

16. A contact arrangement as defined in claim 15, wherein said contact plate comprises one of a sintered or saturated material based on Cu-Cr.

17. A contact arrangement as defined in claim 1, wherein said contact plate has a maximum thickness of 2 mm.

18. A contact arrangement as defined in claim 1, wherein the first and second ends of said at least two winding sections are separated by gaps.

19. A contact arrangement as defined in claim 18, wherein said radially oriented slots that divide each said contact plate into at least two sectors are located to correspond with the positions of said gaps between the ends of said winding sections.

20. A contact arrangement as defined in claim 1, and further including a supporting body comprised of an electrically poorly conducting material located between said contact pin and said contact plate for supporting said contact plate.

21. A contact arrangement as defined in claim 1, wherein said coil body comprises a member molded from one of a casting and pressing substance.

22. A contact arrangement as defined in claim 21, wherein a space is provided between the ends of each of said at least two winding sections which are filled by a one of a shaped-in insulating members and shaped-in poorly conducting metal bodies.

23. A contact arrangement as defined in claim 1, wherein each switch contact further includes an intermediate ring disposed between said at least two winding sections and said contact plate so that current threads leading to a contact point of said switch contact lying within said at least two winding sections pass through said contact plate in a direction parallel to the switch axis.

24. A contact arrangement as defined in claim 23, wherein said intermediate ring has a thickness corresponding to at least the thickness of said contact plate.

25. A contact arrangement as defined in claim 23, wherein said intermediate ring has radially oriented slots which are located congruently with said at least two radially oriented slots of said contact plate.

* * * * *